US005299739A

United States Patent [19]

Takahashi et al.

[11] Patent Number: 5,299,739

[45] Date of Patent: Apr. 5, 1994

[54] ULTRASONIC WAVE NEBULIZER

[75] Inventors: Minoru Takahashi; Makoto Ono, both of Chiba, Japan

[73] Assignee: TDK Corporation, Tokyo, Japan

[21] Appl. No.: 889,067

[22] Filed: May 26, 1992

[30] Foreign Application Priority Data

| | | | |
|---|---|---|---|
| May 27, 1991 | [JP] | Japan | 3-149252 |
| Jul. 26, 1991 | [JP] | Japan | 3-210101 |
| Oct. 14, 1991 | [JP] | Japan | 3-091382[U] |
| Oct. 21, 1991 | [JP] | Japan | 3-094132[U] |
| Nov. 16, 1991 | [JP] | Japan | 3-102285[U] |
| Dec. 5, 1991 | [JP] | Japan | 3-108593[U] |

[51] Int. Cl.[5] ..... B05B 3/14

[52] U.S. Cl. ..... 239/102.2; 239/DIG. 23; 310/316; 310/317; 310/324; 310/345

[58] Field of Search ..... 239/102.1, 102.2, DIG. 23, 239/4; 310/324, 345, 316, 317

[56] References Cited

U.S. PATENT DOCUMENTS

| | | | |
|---|---|---|---|
| 2,855,244 | 10/1958 | Camp | 239/102.2 |
| 3,189,280 | 6/1965 | Drayer | 239/4 |
| 3,989,042 | 11/1976 | Mitsui et al. | 239/102.2 |
| 4,044,297 | 8/1977 | Nobue et al. | 239/102.2 |
| 4,469,974 | 9/1984 | Speranza | 239/102.2 |
| 4,815,661 | 3/1989 | Anthony | 239/102.2 |
| 5,021,701 | 6/1991 | Takahashi et al. | 239/102.2 |
| 5,152,456 | 10/1992 | Ross et al. | 239/4 |
| 5,173,274 | 12/1992 | Owen | 239/102.2 |

FOREIGN PATENT DOCUMENTS

| | | | |
|---|---|---|---|
| 0110843 | 8/1980 | Japan | 239/102.2 |
| 63-38950 | 5/1983 | Japan . | |
| 63-35824 | 8/1983 | Japan . | |
| 0556577 | 6/1986 | U.S.S.R. | 239/102.2 |

*Primary Examiner*—Andres Kashnikow
*Assistant Examiner*—Christopher G. Trainor
*Attorney, Agent, or Firm*—Martin Novack

[57] ABSTRACT

An ultrasonic wave nebulizer for converting water or liquid to mist has a disc-shaped piezoelectric vibrator (1) which has a pair of surfaces one of which is defined as an operation surface. A mesh (3) is located close to said operation surface so that a gap (G) or a thin water or liquid film is defined between the mesh and the operation surface. The gap spacing is smaller than the diameter of water drop which is composed by surface tension of water when no mesh were located. Upon excitation of the vibrator with high frequency, the water film is converted to mist. Fresh water is supplied in said gap spacing through capillarity. The exciting frequency is almost the same as the resonant frequency of the vibrator. The present nebulizer is useful for a small atomizer which operates with small power consumption.

20 Claims, 10 Drawing Sheets

ULTRASONIC WAVE NEBULIZER

BACKGROUND OF THE INVENTION

The present invention relates to an ultrasonic wave nebulizer which atomizes water or liquid with small power consumption.

Conventionally, an ultrasonic wave nebulizer for atomizing water to adjust room humidity has been known. In that atomizer, an ultrasonic wave vibrator which vibrates in thickness direction is mounted at a bottom of a water tank. FIG. 1A shows a prior atomizer in which a tank 102 which has an ultrasonic wave vibrator 103 at the bottom of the same contains water 101. When the piezoelectric vibrator 103 vibrates, water column 104 is generated on surface of water 101, and the water column 104 generates fine mist.

FIG. 1B shows the relations between water depth (H) and amount of generated mist (vertical axis). When the vibration frequency is 1.7 MHz, and the diameter of the vibrator is 20 mm, the maximum generation of mist is obtained when the water depth is from H=30 mm to H=40 mm.

However, the prior atomizer has the disadvantage that the size of the device is rather large, since the vibrator must be mounted at the bottom of the water tank with the depth of 30–40 mm.

Further, the prior atomizer has the disadvantage that the power consumption is rather large as shown in FIG. 1C in which the horizontal axis shows the power consumption, and the vertical axis shows the amount of the mist. The minimum power consumption $W_0$ in a prior art is around 6 watts. Since an atomizer for converting 400 cc/hour of water to mist consumes about 40 watts, power consumption is too high to a battery operating atomizer or a portable atomizer.

Another prior atomizer is shown in JP UM second publication 38950/88 as shown in FIGS. 2A and 2B, in which the numeral 111 is a cone shaped horn having a resonator plate 112 on one end having the smaller diameter of the horn 111, and a piezoelectric vibrator 113 on the other end having the larger diameter of the horn 111. The numeral 114 is a capillary tube for supplying water on the resonator plate 112. The length of the horn 111 or the length between the plate 112 and the vibrator 113 is designed to be half wavelength. As the vibrator of the vibrator 113 is amplified according to the ratio of the area of the plate 112 and the area of the vibrator 113, the amplitude of the plate 112 is very large, and the water drop on the plate 112 is atomized.

However, the atomizer of FIG. 2 has the disadvantages that (1) water drop only close to the outlet of the tube 114 is atomized, and so, the essential operation area of the plate 112 is small, (2) as the vibration is mechanically amplified, the horn must be manufactured very precisely, and the trouble would happen due to the difference of the thermal expansion between the vibrator and the horn, and (3) the size of mist is rather large (for instance 20 μm), as the operation frequency must be rather low (100–150 kHz for instance) because of the mechanical amplification. If the plate 112 is covered with a mesh in order to provide fine mist, the conversion efficiency from water to mist is decreased because of the presence of a mesh.

SUMMARY OF THE INVENTION

It is an object of the present invention to overcome the disadvantages and limitations of a prior nebulizer by providing a new and improved nebulizer.

It is also an object of the present invention to provide a nebulizer which atomizes water or liquid to mist with small power consumption.

It is also an object of the present invention to provide a nebulizer which is small in size.

Another object of the present invention is to provide a nebulizer which generates fine mist.

The above and other objects are attained by an ultrasonic wave nebulizer comprising; a piezoelectric vibrator having a pair of electrodes on each surfaces of the vibrator and defining an operation surface to one of the surfaces; a holder for holding said vibrator; a mesh having at least portion located close to said operation surface so that an essential gap space is provided between said portion of the mesh and the operation surface of the vibrator and thin liquid film is provided in said gap space through capillarity; means for supplying liquid to said gap space; a high frequency generator; connecting means for connecting said generator to said electrodes of the vibrator; said vibrator vibrating in thickness direction of the vibrator upon being excited with high frequency power between said electrodes to convert said thin liquid film to mist.

BRIEF DESCRIPTION OF THE DRAWINGS

The foregoing and other objects, features and attendant advantages of the present invention will be appreciated as the same become better understood by means of the following description and accompanying drawings wherein.

DESCRIPTION OF THE PREFERRED EMBODIMENTS

Figure 3:
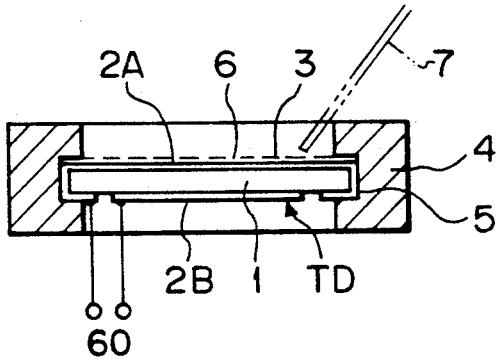
FIG. 3 is a cross section of the ultrasonic wave nebulizer according to the present invention.
Figure 4:
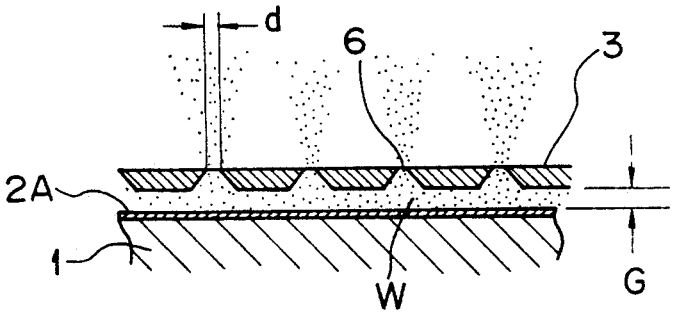
FIG. 4 is a partially enlarged view of FIG. 3.

FIGS. 3 and 4 show the first embodiment of the ultrasonic wave nebulizer for atomizing water and/or liquid according to the present invention. In those figures, the numeral 1 is a piezoelectric vibrator which has a front electrode 2A and a rear electrode 2B. Preferably, it is disc shaped, having uniform thickness. Electrodes 2A and 2B are plated on the surfaces of the vibrator. The vibrator 1, and the electrodes 2A and 2B provide a vibrator element TD. One surface of the vibrator element, the surface of the electrode 2A in the embodiment, is defined as an operation surface which converts water to mist. A mesh 3 which has a large number of holes 6 is placed close to said vibrator element TD. The vibrator element TD and the mesh 3 are kept in a ring shaped groove 5 provided in inner surface of a cylindrical resilient holder 4.

In one embodiment, the vibrator is made of ceramics, which is polarized.

Figure 5:
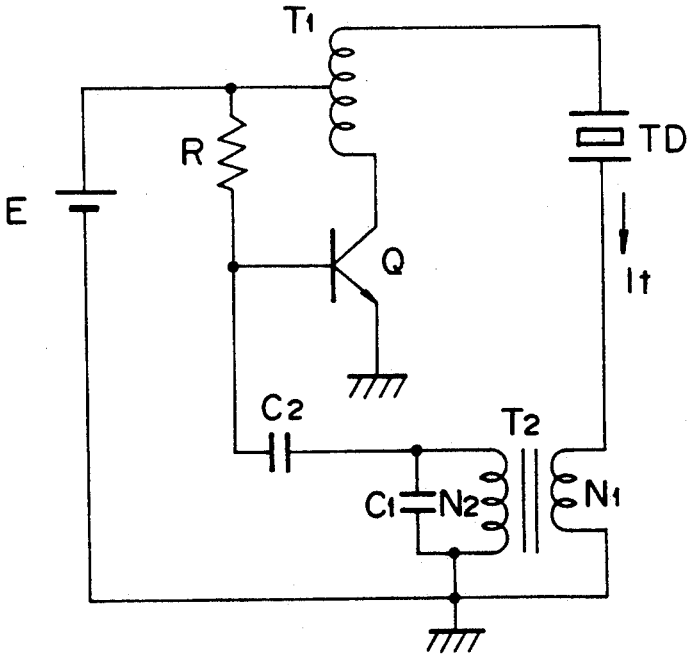
FIG. 5 is a circuit diagram of an oscillator which is used for exciting a vibrator.

The front electrode 2A is partially folded to the rear surface as shown in the figure, and the rear electrode 2B is a little smaller than the diameter of the disc so that the electrodes 2A and 2B are not short-circuited with each other. A pair of lead wires are coupled with the electrodes 2A and 2B, so that they are coupled with an exciting oscillator (as shown in FIG. 5) through a terminal 60. The lead wires are coupled with the rear surface of the vibrator, but not the operation surface. The vibrator 1 is excited by applying alternate power between the electrodes 2A and 2B. The exciting frequency is higher than 1 MHz, and preferably in the range of 1.6 MHz–2.4 MHz. The higher the exciting frequency is, the smaller the generated mist is. So, the high frequency excitation higher than 1 MHz is preferable to generate fine mist less than 10 μm of diameter.

It should be appreciated that a small gap G exists between the mesh 3 and the front electrode 2A, or the operation surface so that water or liquid W which is subject to be converted to mist expands between the mesh and the vibrator through the capillary action. The gap spacing G is preferably smaller than 100 μm. Therefore, the gap spacing is smaller than the diameter of a water drop which would be placed on a vibrator by surface tension of water if no mesh were provided. The gap G is provided by supporting the mesh 3 on the vibrator 1 through a thin ring shaped support (not shown). Therefore, it should be appreciated that very thin water film covers the vibrator, and that film is atomized. Because of the very thin film water, the water is atomized with relatively low power.

The mesh 3 is made of for instance stainless steel with the thickness 10 μ, and a large number of holes each of which has the diameter d around 5–100 μm. The numeral 7 is a supply tube for supplying water or liquid on the vibrator element TD.

Although the hole 6 in FIG. 4 is tapered so that the hole is larger downwardly, an opposite tapered hole or no tapered hole of the mesh is of course possible.

Converted mist is released into air through holes of the mesh. In this case, it should be noted that the size of mist, or diameter of each mist is defined by exciting frequency for a vibrator, but not diameter of holes of the mesh.

FIG. 5 shows a circuit diagram of an oscillator which excites the vibrator 1. In the figure, the symbol Q is a transistor for oscillation, $T_1$ is a booster transformer, $T_2$ is a tuning transformer having a primary winding $N_1$ coupled with the vibrator element TD in series and a secondary winding $N_2$ coupled with a capacitor $C_1$ in parallel. The resonance frequency of the tuning circuit of the secondary winding $N_2$ and the capacitor $C_1$ is almost the same as the resonance frequency of the vibrator element TD. It should be appreciated that the fact that the tuning frequency of the oscillator circuit is the same as that of the vibrator element is one of the features of the present invention. In a prior art, a vibration element is excited with the frequency higher than the resonance frequency of the element so that the vibration element has inductive characteristics.

The symbol $C_2$ is a capacitor for preventing DC potential to the transformer. The symbol R is a resistor for providing base potential to the transistor, and E is a DC power supply (for instance 6–12 V) which is for instance a battery.

FIG. 5 shows the embodiment of self-oscillation circuit of current feed-back type so that a vibrator element TD is excited in the thickness direction with the frequency close to the resonant frequency $f_r$ of the vibrator element.

In FIG. 5, when the transistor Q is in ON state, the potential is applied to the vibrator element TD which then vibrates with the frequency close to the resonant frequency of the vibrator, and the resonant signal which is tuned by the tuning transformer $T_2$ is fed back to the transistor Q. Then, the transistor Q turns ON again. The circuit keeps the oscillation so that the current $I_t$ in the vibrator is the maximum, in another word, the oscillation frequency is close to the resonant frequency $f_r$ of the vibrator element TD.

When the oscillation circuit of FIG. 5 applies the excitation power between the electrodes 2A and 2B of the vibrator element TD of FIG. 3 (for instance the frequency is 2.4 MHz) so that the vibrator element is vibrated in the thickness direction, and the supply capillary 7 supplies liquid or water which is subject to mist on the vibrator TD, the liquid or water expands in the thin gap G between the operation surface of the vibrator ceramics 1 and the mesh 3. And, a liquid column is generated on each small hole 6 of the mesh 3. Then, the top portion of those liquid columns is converted to mist by the vibration of the vibrator, and the mist is diverged into air.

It should be understood in that embodiment that the mesh 3 provides the thin water film of uniform thickness on the vibrator. The area of the liquid is large as the water film is thin, and so, the ultrasonic wave energy is efficiently converted to mist.

Figure 1A:
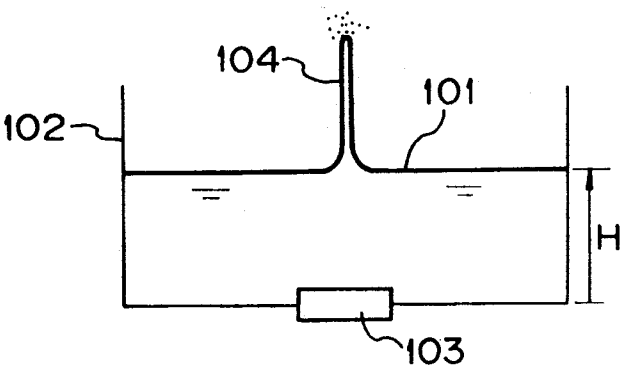
Fig. 1(A) PRIOR ART
FIGS. 1(A), 1(B) and 1(C) show prior ultrasonic wave nebulizer.

When the input power to the vibrator element TD is 3.5 watt, the water of 2 $cm^3$/minute is converted to mist in our experiment. So, the amount of mist for each input power is quite high as compared with with that of FIG. 1A.

As no horn like that, the prior art device is necessary, the present invention provides a small size nebulizer.

Figure 1B:
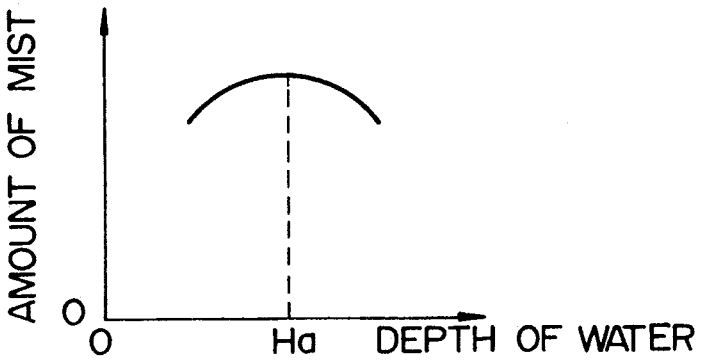
Fig. 1(B) PRIOR ART
Figure 1C:
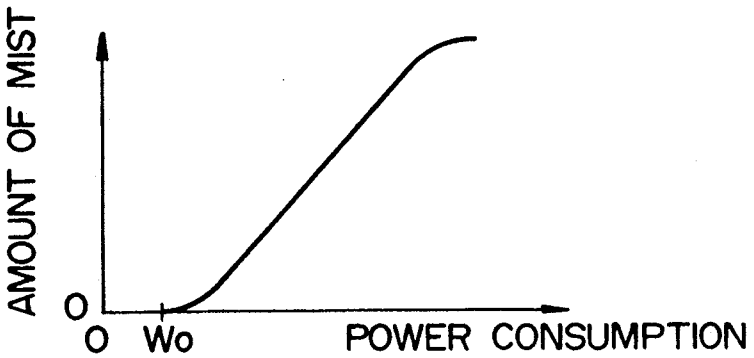
Fig. 1(C) PRIOR ART
Figure 2A:
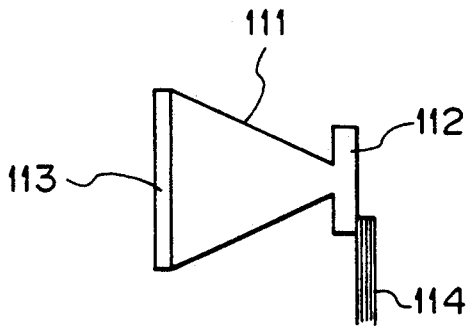
Fig. 2(A) PRIOR ART
FIGS. 2(A) and 2(B) show the structure of another prior ultrasonic wave nebulizer.
Figure 2B:
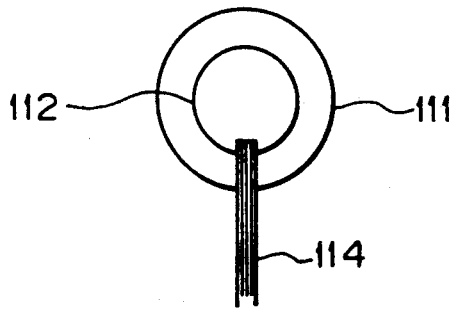
Fig. 2(B) PRIOR ART

One of the important features of the present invention as compared with the prior structure of FIG. 1 is that the operation surface of the vibrator is essentially disposed in air, while the operation surface of the prior art is disposed in water for cooling the vibrator. If the vibrator in the prior art is disposed in air, it would be broken in a short time because of high input power to the vibrator. So, the prior art must have an alarm means for switching off the vibrator when no water is supplied. The present vibrator is not broken even when no liquid or no water is supplied, since an input power is small. So, no alarm means for switching off a vibrator is necessary in the present invention. The input power of high frequency to a vibrator in the present invention is preferably less than 5 watts.

Figure 6:
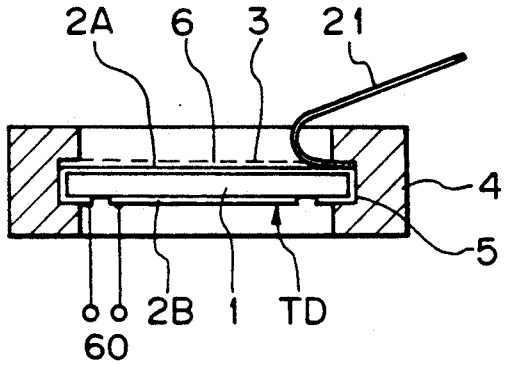
FIG. 6 is a modification of a vibrator.

FIG. 6 shows the modification of the invention. In FIG. 6, a supply felt 21 is used, instead of a supply capillary tube 7, for supplying liquid or water on the peripheral portion of the vibrator element TD.

Figure 7:
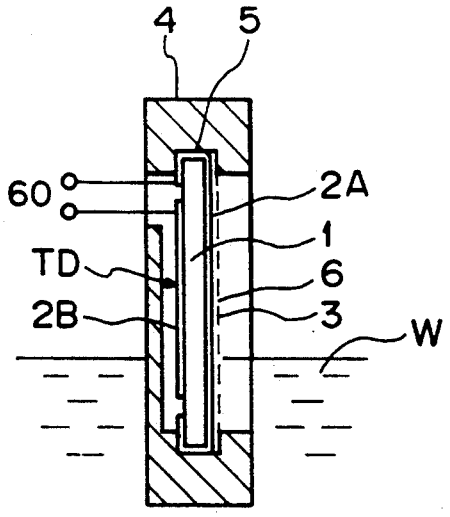
FIG. 7 is another modification of a vibrator.

FIG. 7 shows another modification, which has no specific water supply means. In this modification, a part of the vibrator TD and a part of the mesh 3 are placed in liquid or water which is subject to mist, and the liquid or water rises up and expands in the gap between the vibrator and the mesh through capillarity.

Figure 8A:
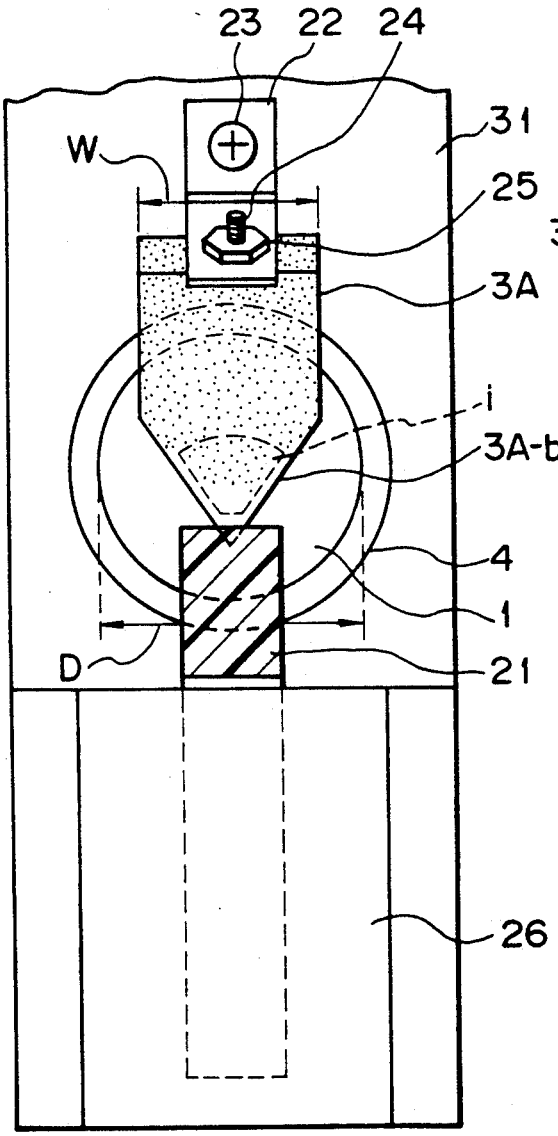
FIGS. 8(A), 8(B), 8(C) and 8(D) show another embodiment of a nebulizer.
Figure 8B:
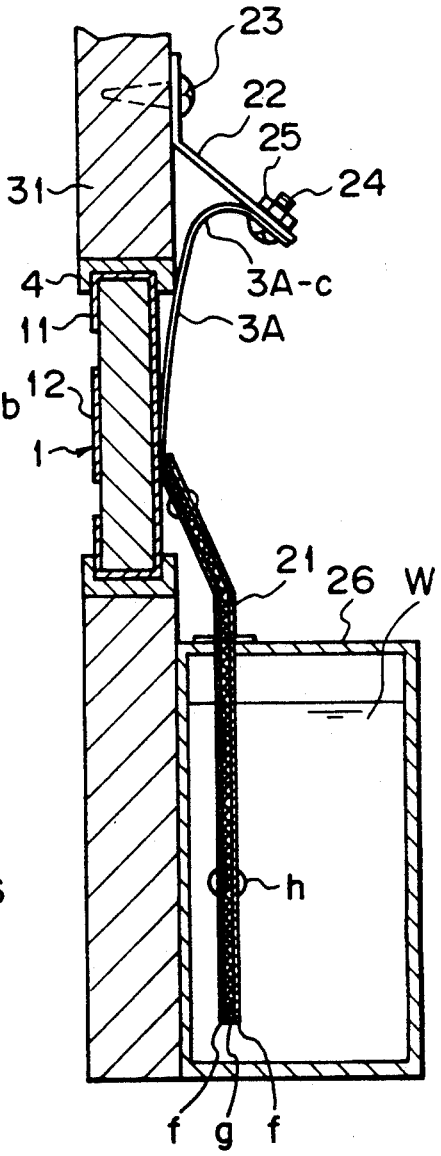
Figure 8C:
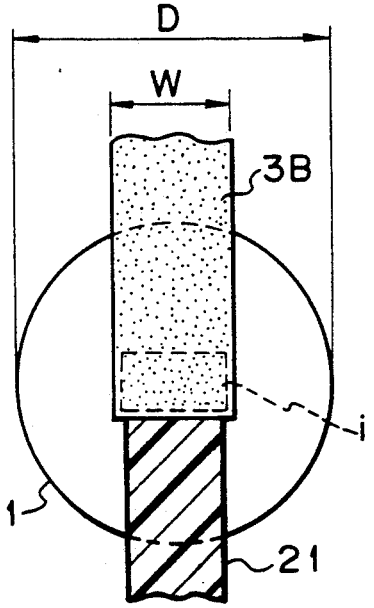
Figure 8D:
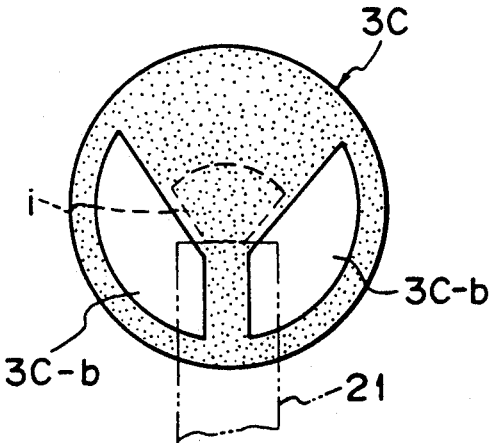

FIGS. 8(A), 8(B), 8(C) and 8(D) show another embodiment of the present invention. The essential feature of this embodiment is that the width of a mesh is smaller than the diameter of a vibrator. FIG. 8(A) is a plan view, FIG. 8(B) is an enlarged side view, and FIGS. 8(C) and 8(D) show the modifications of a mesh.

A disc shaped vibrator 1 is kept in a resilient holder 4, which is fixed to the main holder 31. The mesh 3A which has a plurality of small holes is tapered as shown in the figure so that the extreme end **3A-*b* of the mesh 3A is narrowed. The narrow tapered end 3A-*b* is touched with the central portion of the vibrator 1. Thus, the essential width W which provides a gap space between the mesh and the vibrator 1 is smaller than the diameter D of the vibrator 1**.

In the above structure, the mist conversion is effected in the area (i) in which the thin gap is provided between the mesh 3A and the vibrator 1.

The mesh 3A is fixed to the holder 31 through an essentially L-shaped plate 22 which is fixed to the holder 31 by using a screw 23. The mesh 3A is fixed to the L-shaped plate by using a screw 24 and a nut 25 so that the tapered end **3A-*b* is positioned close to the vibrator 1**.

The water or liquid which is subject to mist conversion is contained in the container 26 which supplies water to the area (i) through the capillary attraction by a supply means 21, which has a pair of thin plastics sheets f—f which sandwich fiber g. The fiber g and the sheets f—f are fixed by the stopper h. The supply means 21 has one end in the water W, and the other end on the mesh 3A at the area (i). Thus, the water W is supplied to the area (i) through the capillary attraction to the area (i), and the water is converted to mist.

In the experiment of the structure of FIGS. 8(A), 8(B), 8(C) and 8(D), the water of 2 $cm^3$/minute is converted to mist with the supply power of 3 W. Since the size of mist depends upon the exciting frequency, and not the size of the holes of the mesh, the preferable exciting frequency is 1.0–3.0 MHz so that a fine mist is obtained.

The amount of water supplied by supply means 21 must be smaller than the mist conversion capability at the area (i) by the vibrator 1, since if too much water is supplied, the mist conversion stops and no mist is generated.

FIGS. 8(C) and 8(D) show two modifications of the mesh. FIG 8(C) shows the rectangular mesh 3B which has no tapered end. The width W of the mesh 3B is smaller than the diameter D of the vibrator 1. The end of the mesh 3B is placed close to the vibrator 1 so that the narrow gap is provided between the mesh and the vibrator at the area (i).

FIG. 8(D) shows another modification 3C of the mesh, in which the mesh is circular, but has a pair of fan-shaped windows **3C-*b* so that an essentially tapered end (i) with the width smaller than the diameter of the vibrator disc, is provided around the center of the mesh. The diameter of the mesh 3C is almost the same as that of the vibrator 1**.

The embodiment of FIGS. 8(A), 8(B), 8(C) and 8(D) has the advantage that a uniform gap with the desired spacing is obtained between a mesh and a vibrator. In the structure of FIG. 3, when a mesh is deformed, a uniform gap with desired spacing is not obtained. When a gap is not uniform, the thickness of water film is then not uniform, and the resonant frequency of the vibrator which has water film has the distribution on the operation surface, because of difference of thickness of water film. As the vibrator must be excited with the frequency which is almost the same as the resonance frequency of the vibrator, the non-uniform water film decreases the mist conversion.

Figure 9A:
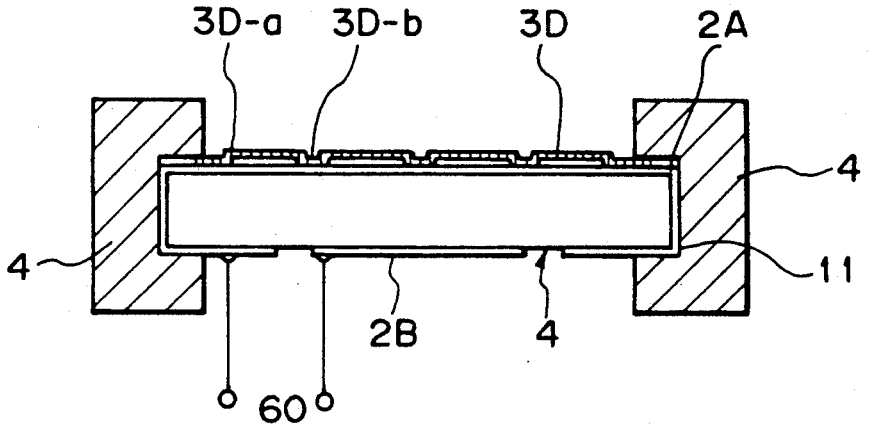
FIGS. 9(A) and 9(B) are still another modification of a vibrator.
Figure 9B:
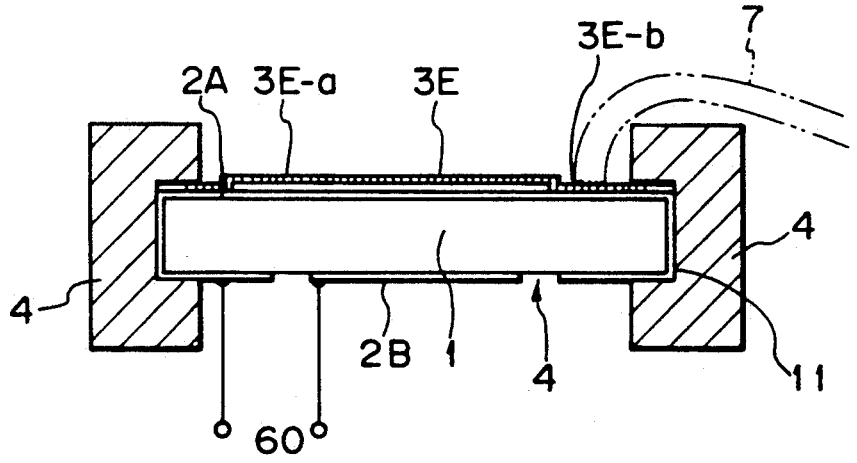

FIGS. 9(A) and 9(B) show the modification which provides the desired spacing of a gap between a mesh and a vibrator. The same numerals in FIGS. 9(A) and 9(B) show the same members as those in FIG. 3.

In FIG. 9(A), the mesh 3D has steps so that a plurality of projected portions **3D-*a* and a plurality of recessed portions 3D-*b* are provided on the mesh 3D. The recessed portions 3D-*b* touch with the vibrator 1, so that the gap spacing is provided between the projected portions 3D-*a* and the vibrator 1. As the area of each projected portions is rather small, it is easy to keep the desired gap spacing in the projected portions 3D-*a***. The periphery of the mesh is recessed portions.

FIG. 9(B) shows another modification, in which the mesh 3E has a ring shaped recessed portion **3E-*b*, and a single projected portion 3E-*a*. The gap spacing between the mesh and the vibrator is provided between the projected portion 3E-*a*** and the vibrator.

Figure 10:
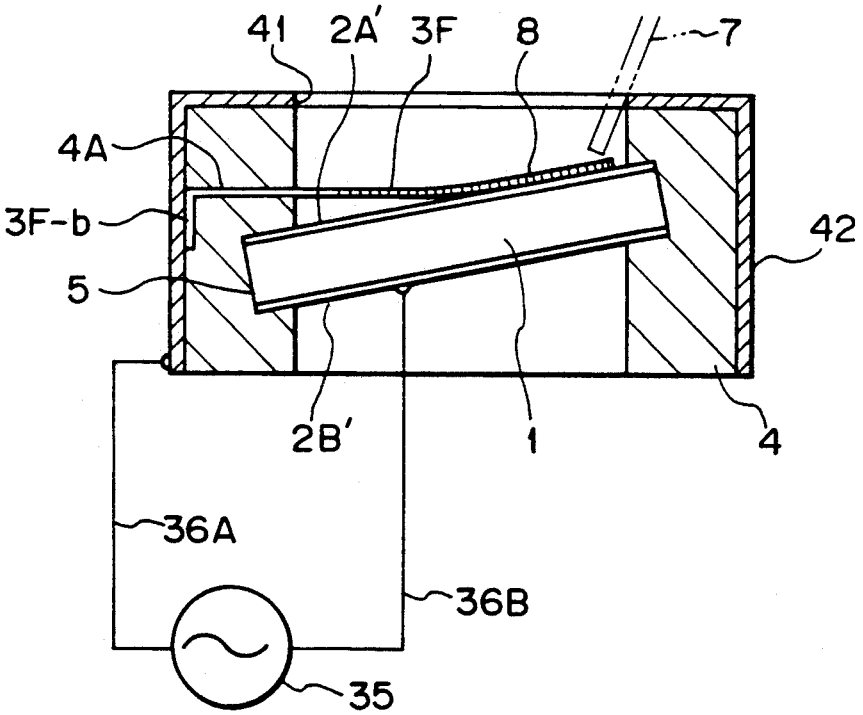
FIG. 10 is still another embodiment of a nebulizer.

FIG. 10 shows another embodiment of the nebulizer according to the present invention. The same numerals in FIG. 10 show the same members as those in FIG. 3.

The essential features of FIG. 10 are that the electrodes 2A' and 2B' of the vibrator have the same diameter as that of the vibrator, and have no offset portion, and that the power is supplied to the vibrator through the conductive mesh 3F. It should be noted that the electrode 2A in FIG. 3 is offset to the rear surface of the vibrator so that the power is supplied from the rear surface.

In FIG. 10, the numeral 1 is a disc-shaped vibrator, which has a pair of disc-shaped electrodes 2A' and 2B'. The diameter of those electrodes is the same as that of the vibrator 1. The vibrator 1 is sealingly mounted in the annular groove 5 of the resilient holder 4.

The mesh 3F is essentially in rectangular shape, and preferably has a tapered end as shown in FIG. 8. The width of the mesh 3F is smaller than the diameter of the vibrator 1.

One end of the mesh 3F is inserted in the slit 4A which is provided on the holder 4 so that the mesh 3F is essentially holizontally fixed to the holder 4. In this case, the other end of the mesh 3F touches with the vibrator 1, and the preferable gap spacing is provided at some portion between the mesh 3F and the vibrator 1. It should be appreciated that the portion inserted in the holder 4 does not need to be meshed, a mere conductive plate being enough for the operation.

The resilient holder 4 is covered with the conductive cap 42 which has a circular opening 41, and has an essentially L-shaped cross section. The end **3F-*b* of the mesh 3F is offset when the cap 42 engages with the holder 4, and the cap 42 and the mesh 3F are electrically coupled through the offset end 3F-*b* of the mesh 3F**.

The vibrator 1 is excited by the high frequency oscillator 35. The preferable circuit diagram of the oscillator is shown in FIG. 5. The numerals 36A and 36B are lead wires for coupling the oscillator 35 with the vibrator 1. One lead wire 36A is coupled with the cap 42, and the other lead wire 36B is coupled with the electrode 2B' of the vibrator 1. Therefore, it should be noted that only one lead wire is soldered to the vibrator, and so, the assembling work of the vibrator is reduced.

It should be noted that the mesh which is conductive connects electrically the cap 42 and the electrode 2A' of the vibrator 1.

The water or liquid is supplied through the supply tube 7 on the vibrator, and the water or liquid is converted to mist at the portion where the preferable gap spacing between the mesh 3F and the vibrator is provided.

As a modification of FIG. 10, the vibrator 1 may be fixed horizontally, and the mesh 3F may be inclined.

Figure 11:
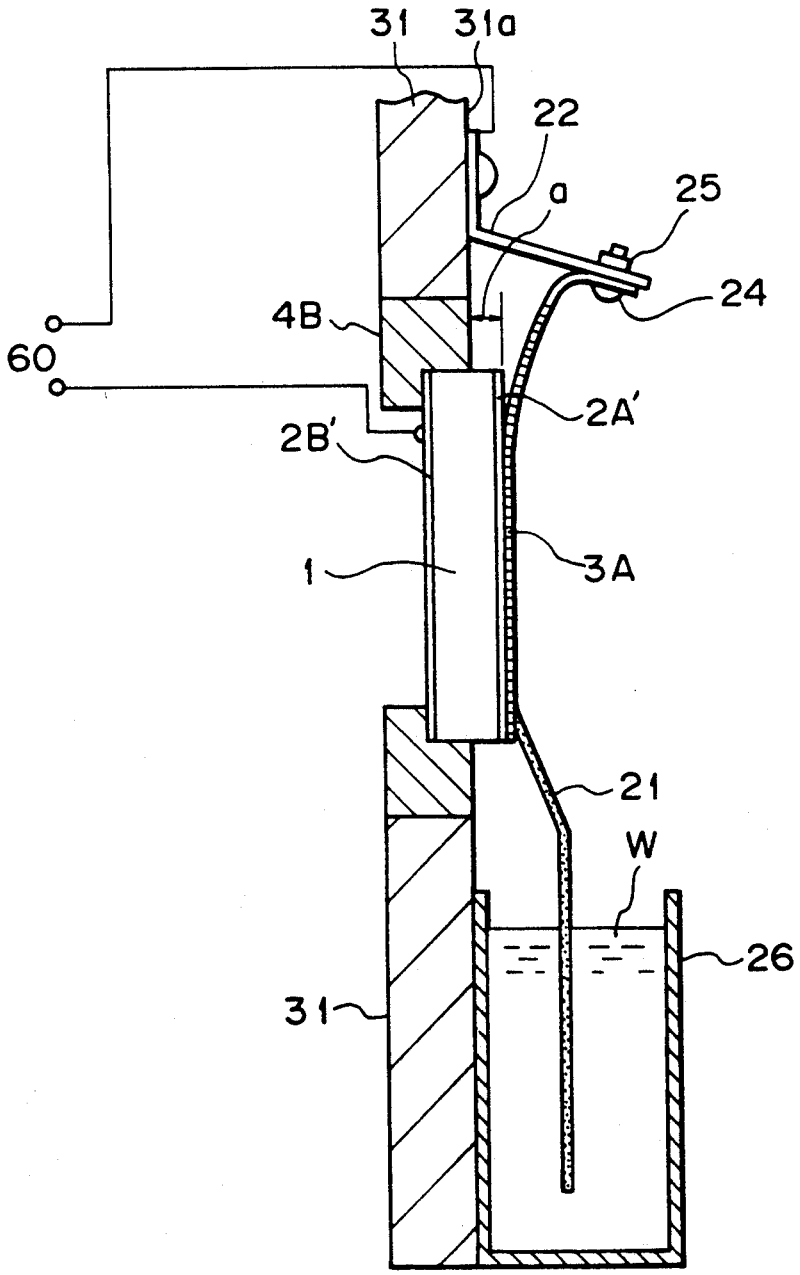
FIG. 11 is still another embodiment of a nebulizer.

FIG. 11 shows another embodiment of the present invention, and the same numerals show the same member as those in FIG. 8. The electrodes 2A' and 2B' in FIG. 11 have the same diameter as that of the vibrator 1, as is the case of FIG. 10.

The essential feature of FIG. 11 is that the operation surface 2A' of the vibrator 1 is placed outside of the holder 4B, so that the difference (a) is provided between the operation surface 2A' of the vibrator 1 and the main surface 31*a* of the holder 31. The advantage of that structure is that all the area of the operation surface of the vibrator 1 functions to generate mist. So, a small diameter of vibrator is enough for operation.

The vibrator 1 is sealingly fixed to the resilient holder 4B by adhesive or snap fix. The electrical lead wires are coupled with the rear electrode 2B' and the L-shaped plate 22 which is coupled electrically with the electrode 2A' by means of the mesh 3A. Alternatively, the electrical lead wires may be coupled with the electrodes 2A' and 2B'. Those electrical lead wires are connected to an oscillator (not shown) through the terminal 60.

The mesh 3A is engaged with the operation surface 2A of the vibrator. The shape of the mesh 3A may be tapered rectangular as shown in FIG. 8A, or rectangular, or circular with a pair of sector windows. One end of the mesh 3A is fixed to the L-shaped plate 22, which is then fixed to the holder 31, as is the case of FIG. 8.

The water tank 26 which contains water W supplies water to the vibrator 1 by a capillary means 21. The water thus supplied to the vibrator 1 provides thin water film between the operation surface of the vibrator 1 and the mesh 3A, and the water film is converted to mist by the ultrasonic wave vibration.

Figure 12:
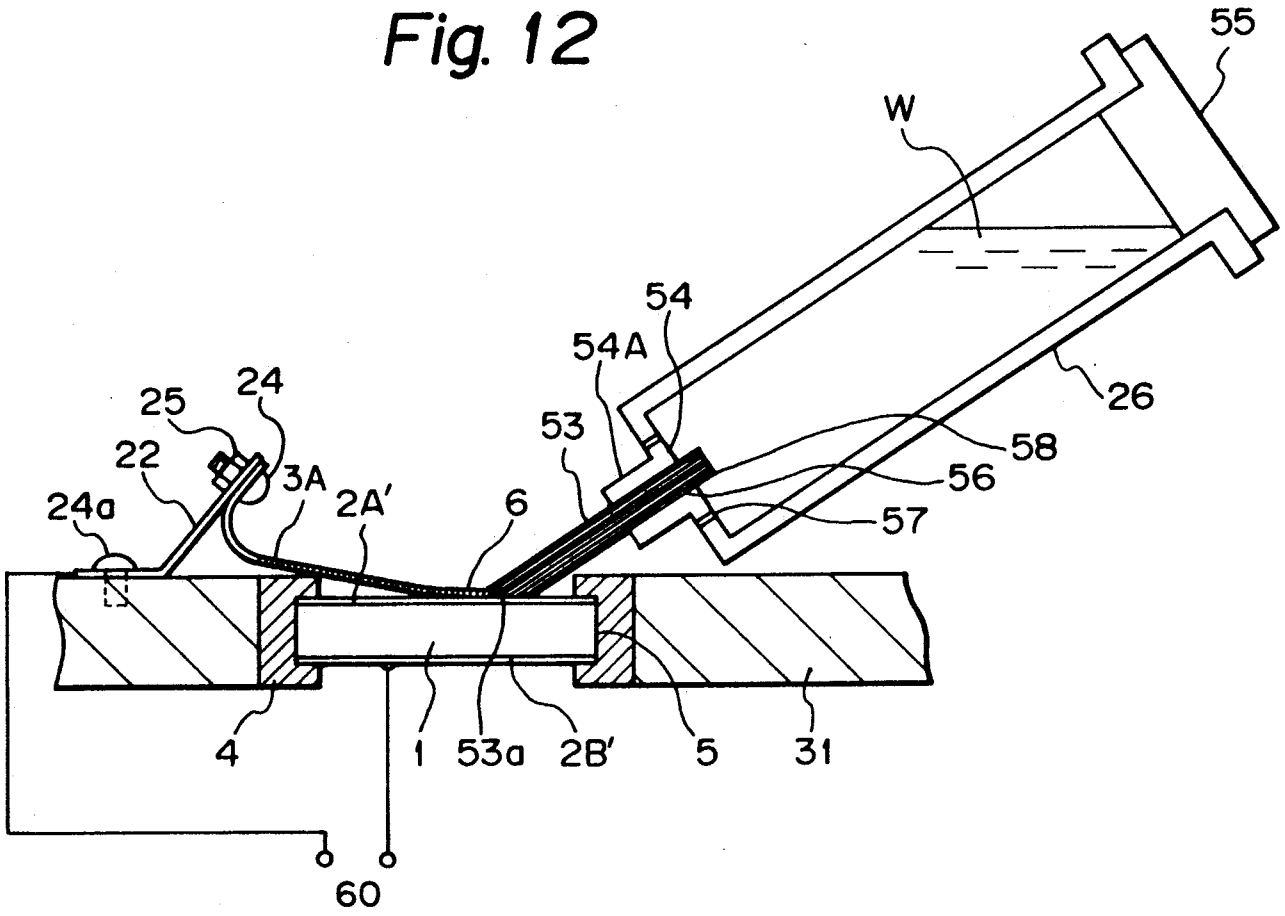
FIG. 12 is still another embodiment of a nebulizer.

FIG. 12 shows another embodiment of the present invention. The same numerals in FIG. 12 show the same members as those in FIG. 8.

The important features of FIG. 12 are that a vibrator is placed horizontally, and that the water tank 26 is located at the higher level than the operation surface of the vibrator 1 so that the water is supplied to the vibrator 1 downwardly.

The structure of a vibrator is similar to that of FIG. 10 which has a pair of electrodes having the same diameter as that of a vibrator. However, other types of vibrators, for instance, the vibrator of FIG. 3, may be used in the embodiment of FIG. 12.

In FIG. 12, the numeral 1 is a vibrator which has a pair of electrodes 2A' and 2B' on the surfaces of the vibrator disc. The vibrator 1 is mounted in an annular groove in a resilient holder 4 which is fixed in a rigid holder 31. a conductive mesh 3A which is in rectangular shape, or tapered rectangular shape, or circular shape with a pair of sector windows as shown in FIG. 8B or FIG. 8C is engaged with the operation surface of the vibrator so that one end of the mesh contacts with the operation surface of the vibrator. The other end of the mesh is fixed to the L-shaped plate 22 by a screw 24 and a nut 25. The L-shaped plate 22 is then fixed to the rigid holder 31 by the screw 24*a*. The vibrator 1 is supplied high frequency energy through the rear electrode 2B' and the front electrode 2A' which is connected to the terminal 60 through the mesh 3A, and the L-shaped conductive plate 22.

The water tank 26 is located above the vibrator 1, and has a cap 55 which seals the tank 26. The tank 26 extends a hollow extension 54A at the bottom 54 of the tank 26. The bottom 54 has at least one small hole 57. The diameter of the hole 57 is for instance less than 1 mm so that water does not flow through the hole 57 because of the surface tension of water. A bundle of fibers 58 is fixed in said extension 54*a* so that water W in the tank 26 is supplied to the vibrator 1 through the fiber 58. One end of the fiber 58 is slanted, and is engaged with the surface of the mesh 3A. Preferably, the tank 26 is located at any place except just above the vibrator 1 so that the tank does not disturb the operation of the mist generation.

In operation, water in the tank is supplied to the vibrator through the fiber 58. The water thus supplied on the vibrator is converted to mist by the vibration, and then, the fresh water is supplied by the amount which is converted to mist. When water is supplied from the tank, the pressure in the tank 26 decreases, and air is supplied into the tank 26 through a small hole 57.

The advantage of the embodiment of FIG. 12 is that no surplus water is supplied to the vibrator even when the vibrator is switched off. If surplus water is supplied on an operation surface, no mist conversion is carried out. In the structure of FIG. 12, when there exists water on the vibrator 1, no water is supplied to the vibrator, and when water film of the operation surface is exhausted, fresh water is supplied, because of the closed structure of the tank 26. It should be noted that no water spills out through a hole 57, since a hole is very small and prevent water by surface tension.

When water in the tank 26 is exhausted, fresh water is supplied into the tank by opening the cap 55.

In a modification of FIG. 12, lead wires for power supply to a vibrator may be soldered to the electrodes 2A' and 2B', instead of supplying the power through a mesh and an L-shaped plate.

In the above description, a vibrator is located either horizontally, or vertically, in any embodiments. When a nebulizer is used as a smoke generator in a toy of a steam locomotive, a horizontal vibrator would be preferable. In another application of a nebulizer, for instance a spray for medical purposes, a vertical vibrator would be preferable.

From the foregoing it will now be apparent that a new and improved neublizer or an atomizer has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. An ultrasonic wave nebulizer comprising;

a piezoelectric vibrator (1) having first and second surfaces, a pair of electrodes (2A, 2B), one of said electrodes being mounted on each of said surfaces of the vibrator, and one of said surfaces defining an operation surface (2A), a holder (4, 5) for holding said vibrator (1), a mesh (3) having at least a portion located close to said operation surface so that an essential gap space (G) is provided between said portion of the mesh and the operation surface of the vibrator, and a thin liquid film being provided in said gap space through capillarity, means (7) for supplying liquid to said gap space to provide said thin liquid film, a high frequency generator (FIG. 5), connecting means (6) for connecting said generator to said electrodes of the vibrator, said vibrator vibrating in thickness direction of the vibrator upon being excited with high frequency power between said electrodes to convert said thin liquid film to mist.

2. An ultrasonic wave nebulizer according to claim 1, wherein said vibrator (1) is in disc-shaped, of polarized ceramics.

3. An ultrasonic wave nebulizer according to claim 1, wherein said mesh (3A) is in rectangular shape with one end tapered and providing said gap space.

4. An ultrasonic wave nebulizer according to claim 1, wherein said mesh (3B) is in rectangular shape with one end providing said gap space.

5. An ultrasonic wave nebulizer according to claim 1, wherein said mesh (3C) is in circular shape with a pair of sector shaped windows.

6. An ultrasonic wave nebulizer according to claim 1, wherein said mesh (3D,3E) has a step so that the mesh has a projected portion and a recessed portion, and said gap space is provided between the projected portion and the operation surface of the vibrator.

7. An ultrasonic wave nebulizer according to claim 1, wherein said mesh (3F) is conductive, and touches with one of said electrodes, and the connects means connecting said generator with the electrodes of the vibrator through the conductive mesh.

8. An ultrasonic wave nebulizer according to claim 7, wherein said mesh (3F) is held in a slit (4A) provided in the holder (4), which is covered with a conductive cap (42) so that the mesh (3F) is electrically coupled with the cap (42), and said connecting means connects the generator to one of said electrodes (2A') of the vibrator through said conductive cap (42) and said mesh (3F).

9. An ultrasonic wave nebulizer according to claim 1, wherein said operation surface (2A') of the vibrator (1) is out of said holder (4B).

10. An ultrasonic wave nebulizer according to claim 1, wherein said vibrator (1) is held so that the operation surface of the vibrator is essentially horizontal, a closed liquid tank (26) is held above the said operation surface, and a conduit (53) connecting said tank to said operation surface.

11. An ultrasonic wave nebulizer according to claim 1, wherein oscillation frequency of said generator is higher than 1 MHz.

12. An ultrasonic wave nebulizer according to claim 1, wherein said gap spacing (G) is less than 100 μm.

13. An ultrasonic wave nebulizer according to claim 1, wherein period of hole of the mesh is less than 200 μm, and diameter of a hole of the mesh is in the range between 5 μm and 100 μm.

14. An ultrasonic wave nebulizer (FIG. 7, FIG. 11) according to claim 1, wherein said operation surface of the vibrator is essentially held vertically, and the liquid is supplied to the operation surface through capillarity.

15. An ultrasonic wave nebulizer according to claim 1, wherein frequency of the generator is essentially the same as the resonance frequency of the vibrator.

16. An ultrasonic wave nebulizer according to claim 11, wherein the oscillation frequency of said generator is approximate 1.6 MHz.

17. An ultrasonic wave nebulizer according to claim 11, wherein the oscillation frequency of said generator is approximate 2.4 MHz.

18. An ultrasonic wave nebulizer according to claim 1, wherein said high frequency generator is supplied operation power by a battery.

19. An ultrasonic wave nebulizer according to claim 1, wherein one (2A) of the electrodes of the vibrator is offset to a rear surface of the vibrator, said rear surface comprising one of said first and second surfaces.

20. An ultrasonic wave nebulizer according to claim 1, wherein input power to said vibrator from said high frequency generator is less than 5 watts.

* * * * *